US007562612B2

(12) United States Patent
Lucuta et al.

(10) Patent No.: US 7,562,612 B2
(45) Date of Patent: Jul. 21, 2009

(54) CERAMIC COMPONENTS, CERAMIC COMPONENT SYSTEMS, AND CERAMIC ARMOUR SYSTEMS

(75) Inventors: Petru Grigorie Lucuta, Gananoque (CA); Gilles Pageau, Lac Saint Charles (CA); Vlad Lucuta, Kingston (CA)

(73) Assignee: Aceram Materials & Technologies, Inc., Kingston, Ontario (CA)

( * ) Notice: Subject to any disclaimer, the term of this patent is extended or adjusted under 35 U.S.C. 154(b) by 82 days.

(21) Appl. No.: 11/068,663

(22) Filed: Feb. 28, 2005

(65) Prior Publication Data

US 2005/0235818 A1 Oct. 27, 2005

Related U.S. Application Data

(63) Continuation-in-part of application No. 10/332,897, filed as application No. PCT/CA02/01134 on Jul. 24, 2002, now Pat. No. 6,912,944.

(60) Provisional application No. 60/307,378, filed on Jul. 25, 2001.

(51) Int. Cl.
*F41H 5/02* (2006.01)

(52) U.S. Cl. ..... 89/36.02

(58) Field of Classification Search ..... 89/36.02, 89/36.04, 36.05

See application file for complete search history.

(56) References Cited

U.S. PATENT DOCUMENTS 374,150 A 11/1887 Gray
1,264,380 A 4/1918 Dowthard
3,179,553 A * 4/1965 Franklin ..... 428/412
3,395,067 A 7/1968 Lane, Jr.
3,431,818 A 3/1969 King (Continued)

FOREIGN PATENT DOCUMENTS

DE 28 53 154 A1 8/1980

(Continued)

OTHER PUBLICATIONS

US 6,861,120, 03/2005, Howland (withdrawn)

*Primary Examiner*—Bret Hayes
(74) *Attorney, Agent, or Firm*—Carter, DeLuca, Farrell & Schmidt, LLP

(57) ABSTRACT

Several ceramic armour systems are provided herein. One such system is a ceramic armour system for personnel. Such system includes an integral ceramic plate, or a plurality of interconnected ceramic components providing an integral plate. The ceramic has a deflecting front surface or a flat front surface, and a rear surface. A front spall layer is bonded to the front surface of the ceramic plate. A shock-absorbing layer is bonded to the rear surface of ceramic plate. A backing is bonded to the exposed face of the shock-absorbing layer. A second such system is a ceramic armour system for vehicles. Such system also includes an integral ceramic plate, or a plurality of interconnected ceramic components providing an integral plate. The ceramic plate has a deflecting front surface or a flat front surface, and a rear surface. A front spall layer is bonded to the front surface of the ceramic plate. A shock-absorbing layer is bonded to the rear surface of the ceramic plate. The assembly of the front spall layer, the ceramic plate, and the shock-absorbing layer is bolted to the hull of a vehicle, preferably with an air gap, or alternatively without an air gap.

9 Claims, 9 Drawing Sheets

U.S. PATENT DOCUMENTS 3,523,057 A 8/1970 Buck
3,634,177 A * 1/1972 Glaser ..... 428/412
3,649,426 A * 3/1972 Gates, Jr. ..... 428/68
3,705,558 A 12/1972 McDougal et al.
3,813,281 A * 5/1974 Burgess et al. ..... 428/51
3,832,266 A * 8/1974 Archibald ..... 428/432
3,977,294 A * 8/1976 Jahn ..... 89/36.02
4,125,669 A 11/1978 Triebel et al.
4,483,020 A 11/1984 Dunn
4,633,528 A 1/1987 Brandt
4,739,690 A 4/1988 Moskowitz
4,757,742 A 7/1988 Mazelsky
4,812,359 A 3/1989 Hall
4,836,084 A * 6/1989 Vogelesang et al. ..... 89/36.02
4,861,666 A 8/1989 LeGrand et al.
4,908,083 A 3/1990 Hall
4,934,245 A 6/1990 Musante et al.
5,032,466 A 7/1991 Cappa
5,114,772 A 5/1992 Vives et al.
5,318,847 A * 6/1994 Fukushima et al. ..... 428/392
5,326,606 A * 7/1994 Labock ..... 428/49
5,340,633 A * 8/1994 van der Loo et al. ..... 428/114
5,364,679 A 11/1994 Groves
5,368,904 A 11/1994 Stephinson
5,402,703 A 4/1995 Drutleff
5,469,773 A 11/1995 Tarpinian
H1519 H 3/1996 Semple
5,515,541 A 5/1996 Sacks et al.
5,534,343 A * 7/1996 Landi et al. ..... 428/313.5
5,554,816 A 9/1996 Skaggs et al.
5,560,971 A * 10/1996 Emery ..... 428/92
5,604,022 A 2/1997 Andujar
5,635,288 A * 6/1997 Park ..... 428/105
5,738,925 A * 4/1998 Chaput ..... 428/101
5,804,757 A 9/1998 Wynne
5,847,308 A 12/1998 Singh et al.
5,905,225 A 5/1999 Joynt
5,915,528 A 6/1999 Shmuelov
5,996,115 A * 12/1999 Mazelsky ..... 2/2.5
6,009,789 A 1/2000 Lyons
6,112,635 A 9/2000 Groves
6,135,006 A 10/2000 Strasser et al.
6,138,275 A * 10/2000 Sacks ..... 2/2.5
6,170,378 B1 1/2001 Neal et al.
6,174,587 B1 1/2001 Figge, Sr.
6,200,664 B1 3/2001 Figge et al.
6,203,908 B1 3/2001 Cohen
6,253,655 B1 7/2001 Lyons et al.
6,311,605 B1 11/2001 Kellner et al.
6,332,390 B1 * 12/2001 Lyons ..... 89/36.02
6,370,690 B1 4/2002 Neal
6,389,594 B1 5/2002 Yavin
6,408,733 B1 * 6/2002 Perciballi ..... 89/36.02
6,418,832 B1 7/2002 Colvin
6,497,966 B2 12/2002 Cohen
6,500,507 B1 12/2002 Fisher
6,537,654 B1 3/2003 Gruber et al.
6,568,310 B2 * 5/2003 Morgan ..... 89/36.02
6,575,075 B2 6/2003 Cohen
6,586,351 B1 7/2003 Breukers
6,601,497 B2 * 8/2003 Ghiorse et al. ..... 89/36.02
6,609,452 B1 8/2003 McCormick et al.
6,622,608 B1 9/2003 Faul et al.
6,656,570 B1 12/2003 Fels et al.
6,679,157 B2 * 1/2004 Chu et al. ..... 89/36.02
6,698,331 B1 3/2004 Yu et al.
6,709,736 B2 3/2004 Gruber et al.
6,713,008 B1 * 3/2004 Teeter ..... 264/258
6,737,158 B1 * 5/2004 Thompson ..... 428/306.6
6,745,661 B1 * 6/2004 Neal et al. ..... 89/36.02
6,792,843 B2 * 9/2004 Mohr et al. ..... 89/36.02
6,805,034 B1 10/2004 McCormick et al.
6,807,891 B2 10/2004 Fisher
6,826,996 B2 12/2004 Strait
6,862,970 B2 3/2005 Aghajanian et al.
6,895,851 B1 5/2005 Adams et al.
6,899,009 B2 * 5/2005 Christiansen et al. ..... 89/36.02
6,911,247 B2 6/2005 Howland
6,955,112 B1 10/2005 Adams et al.
6,962,739 B1 11/2005 Kim et al.
6,995,103 B2 2/2006 Aghajanian
6,997,218 B1 2/2006 Garcia et al.
7,018,692 B2 3/2006 Kim et al.
2002/0178900 A1 * 12/2002 Ghiorse et al. ..... 89/36.02
2003/0139108 A1 7/2003 Klintworth et al.
2003/0151152 A1 8/2003 Nichelson et al.
2003/0180517 A1 9/2003 Karall
2004/0020353 A1 2/2004 Ravid et al.
2004/0028868 A1 2/2004 James
2004/0048536 A1 3/2004 Granqvist et al.
2004/0097360 A1 5/2004 Benitsch et al.
2004/0118271 A1 6/2004 Puckett et al.
2004/0147191 A1 7/2004 Wen
2005/0005762 A1 1/2005 Lujan
2005/0011347 A1 1/2005 Muller, Jr.
2005/0072294 A1 4/2005 Cohen
2005/0087064 A1 4/2005 Cohen
2005/0188831 A1 9/2005 Squires et al.
2005/0217471 A1 10/2005 Benitsch
2006/0048640 A1 3/2006 Terry et al.
2006/0065111 A1 3/2006 Henry

FOREIGN PATENT DOCUMENTS

DE 29 27 653 A1 1/1981
EP 0 168 746 1/1986
EP 0 334 263 B1 9/1989
EP 0620411 A1 10/1994
EP 0 807 797 B1 11/1997
EP 0 942 255 A1 9/1999
EP 0 994 084 B1 4/2000
EP 0 995 730 B1 4/2000
EP 1 288 607 A1 3/2003
EP 1 337 166 B1 8/2003
EP 1 369 149 A1 12/2003
EP 1 522 817 A1 9/2004
EP 1 521 051 A1 4/2005
EP 1 637 507 A2 3/2006
FR 335605 9/1903
FR 1041126 10/1953
FR 2519133 7/1983
GB 2 156 272 A 10/1985
GB 2 260 600 A 4/1993
GB 2 276 933 A 10/1994
GB 2 276 934 A 10/1994
GB 2 276 934 B 10/1994
GB 2 276 935 A 10/1994
GB 2 277 141 A 10/1994
GB 2 283 902 A 5/1995
GB 2 285 209 A 7/1995
GB 2 287 639 A 9/1995
GB 2 335 388 A 9/1999
GB 2 336 807 A 11/1999
GB 2 377 006 A 12/2002
WO WO 91/07833 5/1991
WO WO 92/09861 6/1992
WO WO 97/16697 5/1997
WO WO 98/44309 10/1998
WO WO 99/22195 A1 5/1999
WO WO 00/33015 A2 6/2000
WO WO 02/41719 A1 5/2002

| | | | |
|---|---|---|---|
| WO | WO 03/086748 | A1 | 10/2003 |
| WO | WO 2004/109216 | A2 | 12/2004 |
| WO | WO 2005/045351 | A1 | 5/2005 |
| WO | WO 2005/098343 | A1 | 10/2005 |

* cited by examiner

CERAMIC COMPONENTS, CERAMIC COMPONENT SYSTEMS, AND CERAMIC ARMOUR SYSTEMS

This application is a continuation-in-part of U.S. Patent application Ser. No. 10/332,897, filed Jan. 15, 2003 now U.S. Pat. No. 6,912,944 which is a national stage application of International Application Number PCT/CA02/01134, published as WO03/010484A1, filed on Jul. 24, 2002, which claims priority to U.S. Provisional Patent Application Ser. No. 60/307,378, filed on Jul. 25, 2001. The priority of these prior applications is expressly claimed and their disclosures are hereby incorporated by reference in their entirety.

FIELD OF THE INVENTION

The present invention relates generally to the field of armours, especially hard armours. More particularly, the present invention relates to ceramic components, to ceramic component systems, and ceramic armour systems.

BACKGROUND OF THE INVENTION

One of the ways of protecting an object from a projectile is equipping that object with an armour. These armours vary in shape and size to fit the object to be protected. A number of materials e.g., metals, synthetic fibres, and ceramics have been used in constructing the armours. The use of ceramics in constructing armours has gained popularity because of some useful properties of ceramics. Ceramics are inorganic compounds with a crystalline or glassy structure. While being rigid, ceramics are low in weight in comparison with steel; are resistant to heat, abrasion, and compression; and have high chemical stability. Two most common shapes in which ceramics have been used in making armours are as pellets/beads and plates/tiles, each having its own advantages and disadvantages.

U.S. Pat. No. 6,203,908 granted to Cohen discloses an armour panel having an outer layer of steel, a layer of plurality of high density ceramic bodies bonded together, and an inner layer of high-strength anti-ballistic fibres e.g., KEVLAR™.

U.S. Pat. No. 5,847,308 granted to Singh et al. discloses a passive roof armour system comprising of a stack of ceramic tiles and glass layers.

The U.S. Pat. No. 6,135,006 granted to Strasser et al. discloses a multi-layer composite armour with alternating hard and ductile layers formed of fibre-reinforced ceramic matrix composite.

Presently, there are two widely used designs of ceramic components in making armours. The first design, known as the MEXAS design in the prior art comprises a plurality of square planar ceramic tiles. The tiles have a typical size of 1"×1", 2"×2", or 4"×4". The second design known as the LIBA design in the prior art comprises a plurality of ceramic pellets in a rubber matrix. Both designs are aimed at defeating a projectile.

These designs protect an object from a projectile impacting at a low angle. However, the thickness of the tiles in the MEXAS design has to be varied depending upon the level of threat and the angle of the impacting projectile. This increases the weight of the ceramic component and subsequently of the armour. These ceramic components are useful for protecting an object from a low level of threat only and are not suitable for protecting an object from projectiles posing a high level of threat, e.g., the threat posed by a Rocket Propelled Grenade (RPG). Furthermore, an armour assembled by joining a plurality of individual tiles is vulnerable to any level of threat at joints.

Various ceramic systems exist. One example is U.S. Pat. No. 5,326,606 to Labock. Labock teaches a bulletproof panel with a ceramic layer surrounded by a polycarbonate layer. Labock specifies that the polycarbonate layer is used to aid in stopping the projectile and needs to be at least three millimeters thick in the front and six millimeters in the rear. Labock therefore teaches a panel that may be used to stop bullets which can be mounted to a vehicle. The thickness of the polycarbonate layer is similar to that of bulletproof glass and provides several disadvantages. If the ceramic central plate is not flat, a polycarbonate layer that includes a thickness of at least three millimeters will not conform to the ceramic plate. Further, the weight of the polycarbonate front and rear layers add substantially to the armour system.

Therefore, there is a need for producing improved ceramic components, ceramic component systems, and ceramic armour systems that are not only capable of defeating the projectile but are also capable of deflecting the projectile upon impact. There is also a need for reducing the weight of the ceramic components used in the armour systems. There is also a need for improved armour systems capable of deflecting and defeating projectiles posing various levels of threats. There is also a need for providing deflecting and defeating capabilities at the joint points of ceramic components. There is also a need for improved close multi-hit capability, reduced damaged area including little or no radial cracking, reduced back face deformation, and reduced shock and trauma to the object. There is also a need for reducing detection of infrared signature of an object. There is also a need for scattering radar signals by the object.

SUMMARY OF THE INVENTION

Aims of the Invention

One object of the present invention to obviate or mitigate at least one of the above-recited disadvantages of previous ceramic components, ceramic component systems, and ceramic armour systems.

It is another object of the present invention to provide ceramic armour systems having improved ballistic performance and survivability, multi-hit capability, reduced damaged area, low areal density, flexible design, reduced back face deformation, shock, and trauma, and many stealth features over prior art systems for personnel protection or vehicle protection.

It is yet another object of the present invention to provide a ceramic armour system for vehicles, crafts, and buildings to protect the surfaces of these structures from damage by fragments.

It is yet another object of the present invention to provide a ceramic armour system that can be used as add-on armour without the requirement of an internal liner in the vehicle.

It is yet another object of the present invention to provide stealth features e.g., air gap, foam layer, and camouflage paint to minimize the attack in a ceramic armour system.

It is yet another object of the present invention to provide an improved ceramic component and improved ceramic component system that are capable of deflecting and defeating the projectile.

A related object of the present invention is to provide means of reducing weight of the ceramic components without compromising deflecting and defeating capabilities thereof.

Another object of the present invention is to provide ceramic armour systems that are capable of deflecting and defeating the projectiles posing various levels of threats.

Statement Of The Invention

The present invention provides a ceramic armour system having, in front to back order, an integral ceramic plate, or a plurality of interconnected ceramic components providing an integral plate, the ceramic plate having a deflecting front surface or a flat front surface, and a rear surface; a front spall layer bonded to the front surface of the ceramic plate; a shock-absorbing layer bonded to the rear surface of ceramic plate; and a backing which is bonded to the exposed face of the shock-absorbing layer.

The present invention also provides a ceramic armour system for vehicles comprising an assembly of an integral ceramic plate, or a plurality of interconnected ceramic components providing an integral plate, the ceramic plate having a deflecting front surface or a flat front surface, and a rear surface; a front spall layer bonded to the front surface of the ceramic plate; a shock-absorbing layer bonded to the rear surface of ceramic plate; wherein the assembly is bolted to the hull of a vehicle at a predetermined distance from the hull, thereby leaving an air gap between the shock-absorbing layer and the hull of the vehicle in order to reduce infrared signature of the vehicle.

Other Features Of The Invention

The ceramic armour system includes a ceramic plate having a plurality of individual abutted or lapped planar ceramic components having a deflecting front surface which is preferably provided with a pattern of multiple nodes thereon. The ceramic plate may be monolithic strike plate, body armour, or protective shield, having a deflecting front surface which is preferably provided with a pattern of multiple nodes thereon. The ceramic plate may be a plurality of individual abutted or lapped curved ceramic components having a deflecting front surface which is preferably provided with a pattern of multiple nodes thereon.

The configuration of nodes in the ceramic components may be spherical, cylindrical, and conical. The nodes may be of the same size, thereby providing a mono-size distribution. The nodes may be of different sizes, thereby providing a bi-modal distribution. One or more of nodes may include longitudinal channel therethrough, thereby lowering the areal density of said armour. Partial nodes may be provided on the edges of each ceramic component for protecting an object from a threat at the joint points of ceramic components. The partial nodes at the edges of two ceramic components become full nodes when the ceramic components are aligned and joined by an adhesive.

In the ceramic armour system, edges of the ceramic components may be overlapping, bevelled, or parallel.

The ceramic component system may have a plurality of individual abutted or lapped planar ceramic components, each having a deflecting front surface which is preferably provided with a single node thereon in a polymer matrix. The shape of the ceramic components may be rectangular, triangular, hexagonal, or square.

The front spall may be a synthetic plastic sheath, a thermoplastic sheath, or a polycarbonate sheath. The front spall may be bonded to the ceramic component system by way of a polymer adhesive. The plastic adhesive may be a polyurethane adhesive.

The shock-absorbing layer may be at least one of a polymer-fibre composite, an aramid fibre, a carbon fibre, a glass fibre, a ceramic fibre, a polyethylene fibre, a ZYALON™ fibre a Nylon 66 fibre, or any combination thereof. The shock-absorbing fibre layer is bonded to rear surface of the ceramic plate, preferably by means of a polyurethane adhesive.

The backing may be at least one layer of poly-paraphenylene terephthalamide fibres (KEVLAR™), polyethylene fibres (SPECTRA™), glass fibres (DAYNEEMA™), ZYALON™ fibres, TITAN ZYALON™ fibres, TITAN KEVLAR™ fibres, TITAN SPECTRA™ fibres, TWARON™ fibres, and SPECTRA-SHIELD™ fibres or combinations thereof, or metals, e.g., steel or aluminum. The backing is bonded to the exposed face of said shock-absorbing layers preferably by a polyurethane adhesive.

The ceramic armour system may include at least two further support layers, e.g., ceramic components which may include, or may be devoid of nodes, or polymer-ceramic fibre composite components, or plastic components, or combination thereof. The support layers are bonded to each other and to the ceramic plate by an adhesive. The adhesive may be polyurethane or ceramic cement. The at least two further support layers are provided with an inter-layer of polymer-ceramic fibres therebetween. The interlayer is bonded to the support layers by an adhesive. The adhesive is preferably polyurethane.

The ceramic armour system may include at least one layer of commercially available foam (FRAGLIGHT™) for scattering radar signals.

The front spall of the ceramic armour system may be provided with a camouflage surface for minimizing attack.

The ceramic armour system may have a ceramic plate comprises a sandwich including a first layer of CERAMOR™ V, a first layer of CERAMOR™ L bonded to said first layer of CERAMOR™ V, a second layer of CERAMOR™ V bonded to said first layer of CERAMOR™ L, and a second layer of CERAMOR™ L bonded to said second layer of CERAMOR™ V.

DETAILED DESCRIPTION

The present invention provides improved ceramic components for use in ceramic armour systems embodying ceramic components for deflecting and defeating projectiles imposing various levels of threats. The present invention also provides a shock absorbing layer for reducing shock and trauma and for providing support to the armour. The present invention also provides enhanced stealth features. A number of terms used herein are defined below.

Ceramic means simple ceramics or ceramic composite materials. As used herein, the term "ceramic" is meant to embrace a class of inorganic, non-metallic solids that are subjected to high temperatures in manufacture or use, and may include oxides, carbides, nitrides, silicides, borides, phosphides, sulphides, tellurides, and selenides.

Deflecting means changing of direction of an incoming projectile upon impact.

Defeating means shattering of an incoming projectile upon impact.

Threat means an article or action having the potential to harm an object. In this disclosure, a projectile has been considered as a threat. However, the threat may come from any other article, for example, an army knife.

Ceramic component system and integral ceramic plate have been used synonymously in this disclosure.

Figure 1:
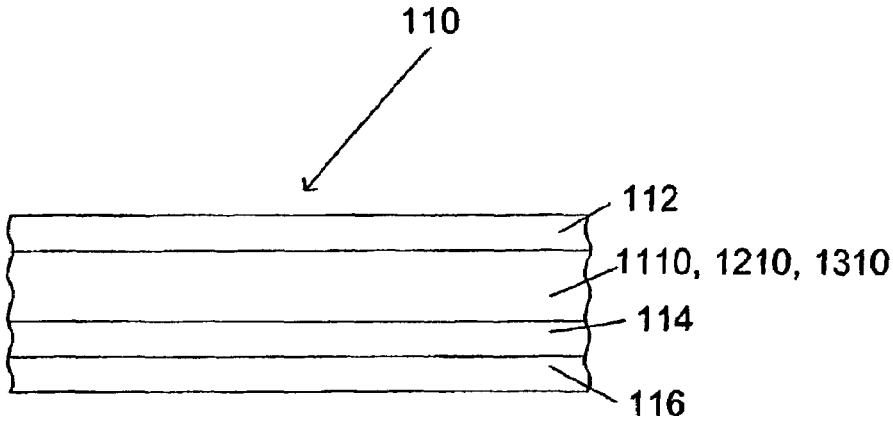
FIG. 1 is a cross section of one embodiment of a ceramic armour system for protecting personnel.

Description of FIG. 1

FIG. 1 shows the cross section of one embodiment of personnel protection ceramic armour system 110 of the present invention. The ceramic armour system comprises a ceramic component 1110, 1210, or 1310 (to be described later). The ceramic component is an integral ceramic plate, or a plurality of interconnected ceramic components providing an integral plate (as will be further described with respect to FIG. 11). The ceramic plate 1110, 1210, or 1310 may have a flat front surface, or may have a deflecting front surface having at least one node thereon, and has a rear surface. A front spall layer 112 (to be described later) is bonded to the front surface of the ceramic component 1110, 1210, or 1310. A shock-absorbing layer 114 is bonded to the rear surface of ceramic component 1110, 1210, or 1310. The shock-absorbing layer 114 may be formed of polymer-fibre composites including aramid fibres, carbon fibres, glass fibres, ceramic fibres, polyethylene fibres, ZYALON™, Nylon 66, or a combination thereof. The shock-absorbing layer 114 may be obtained by layering one type of fibre over another fibre in a suitable orientation and bonding them together with an adhesive. In a preferred embodiment, a shock-absorbing layer of 2 to 8 layers may be created by gluing, either with an epoxy glue or with a polyurethane glue, one layer of carbon fibre over a layer of aramid and repeating the process as often as necessary. The orientation of the fibre layers may be parallel or at any other angle to one another. The shock-absorbing layer 114 may be glued to a polycarbonate sheath at the back face. Use of a shock-absorbing layer 114 in a ceramic armour system reduces shock and trauma, and provides support. This advantage of the shock-absorbing layer 114 has never been disclosed or suggested before in the prior art. A backing 116 (to be described later) is bonded to the exposed face of the shock-absorbing layer 114. These layers are bonded together, preferably with an adhesive.

In another embodiment (not shown), the shock-absorbing layer is used in combination with a ceramic mosaic component system in a chest plate configuration for reducing shock and trauma, and providing support, together with the front spall and the backing. The ceramic mosaic is a known ceramic configuration that is economical because ceramic tiles are mass-produced by pressing.

In yet another embodiment (not shown), the shock-absorbing layer is used with a flat ceramic base, together with the front spall and the backing, for reducing shock and trauma, and providing support.

Figure 2:
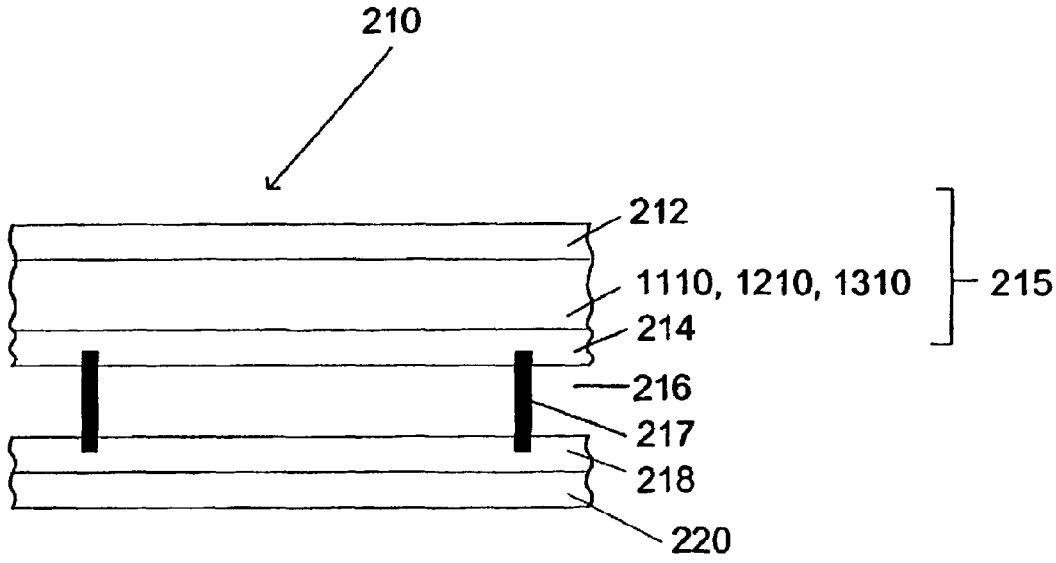
FIG. 2 is a cross section of one embodiment of a ceramic armour system for protecting vehicles.

Description of FIG. 2

The ceramic armour system of the present invention can also protect vehicles, crafts and buildings.

FIG. 2 shows a cross-section of one embodiment of such a ceramic armour system 210 which comprises a ceramic component 1110, 1210, 1310, or 1724 (to be described later). The ceramic component is an integral ceramic plate, or a plurality of interconnected ceramic components providing an integral plate (as will be further described with respect to FIG. 11). The ceramic component 1110, 1210, 1310, or 1724 may have a deflecting front surface including at least one node thereon or may have a flat front surface, and a rear surface. A front spall layer 212 (to be described later) is bonded to the front surface of the ceramic component 1110, 1210, 1310, or 1724. A shock-absorbing layer 214 (to be described later) is bonded to the rear surface of ceramic plate 1110, 1210, or 1310. The above-described sub-structure 215 is disposed at a predetermined distance from the exposed face of the hull 218 of the vehicle with bolts 217. The hull 218 of the vehicle may include a liner 220. This provides an air gap 216 between the exposed face of the shock-absorbing layer 214 and the hull 218. The air-gap 216 between the hull 218 of the vehicle and the shock-absorbing layer 214 of the armour is provided to reduce infrared signature of the vehicle. In a preferred embodiment, the air-gap is 4 to 6 mm. The above-described sub-structure 215 can also be bolted directly to the hull without the air gap if so needed. With the armour system of the present invention, no liner 220 inside the vehicle is required, although it is optional, like the one needed with the prior art MEXAS system.

Scattering of the radar signals is normally obtained by adding a commercially-available foam e.g., FRAGLIGHT™ on top of the front spall layer of the armour system 210. However, together with the nodes on the ceramic component, the scattering of the radar signals can be enhanced significantly.

In one embodiment (not shown), one layer of foam in conjunction with noded ceramic armour systems of the present invention was used to scatter as much as 80% of the incoming signal. In a preferred embodiment, the layer of foam is 4 mm thick.

In another embodiment (not shown), the MAP ceramic component system (to be described later) can be used in the ceramic armour system of this invention that is distinct and superior to the presently-used MEXAS and LIBA systems, to protect vehicles, crafts and buildings. The ceramic material, shape, size, and thickness of the ceramic armour system is determined by the overall design of the ballistic system, the level of threat, and economics. The remaining features, as specified above, may be added to create ceramic armour system for vehicles, crafts and buildings.

In yet another embodiment (not shown), the front spall layer 212 of the armour is provided with a camouflage to minimize an attack.

Figure 3:
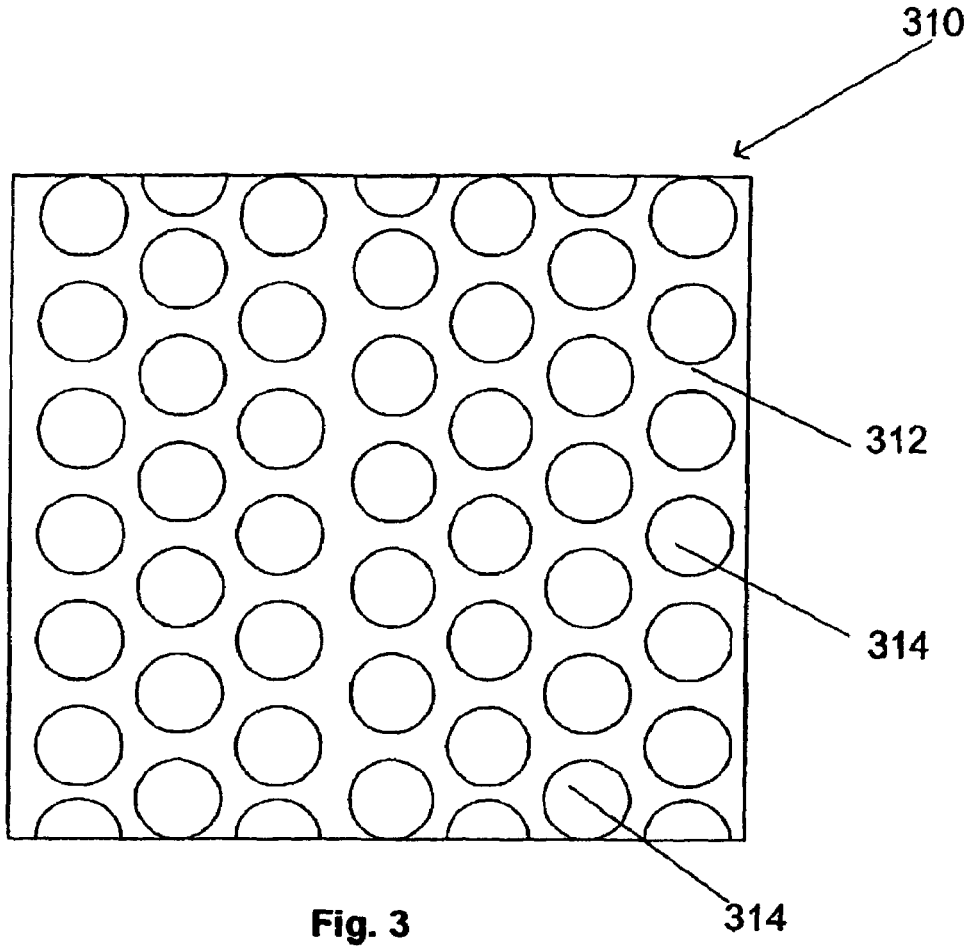
FIG. 3 is a top plan view of a square ceramic component comprising a ceramic base and spherical nodes of one size.
Figure 4:
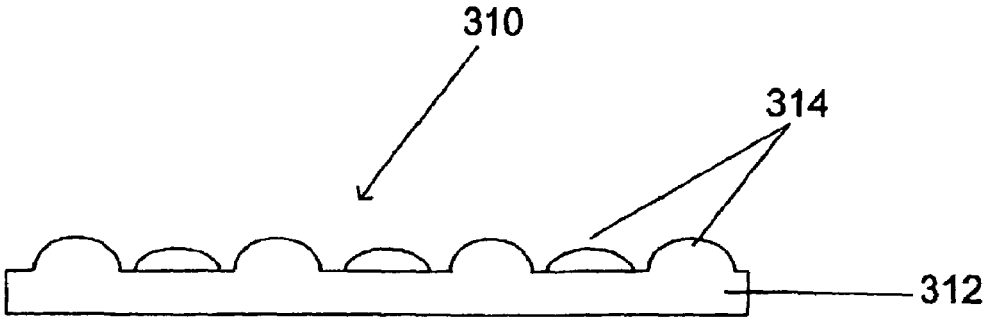
FIG. 4 is a side elevational view thereof.

Description of FIG. 3 and FIG. 4

FIG. 3 and FIG. 4 show a ceramic component 310 having a square ceramic base 312 with a plurality of spherical nodes 314 of one size disposed thereon. While FIG. 3 shows the shape of the ceramic base 312 to be square, it can alternatively be rectangular, triangular, pentagonal, hexagonal, etc. The ceramic component 310 is shown to be planar herein, but it can alternatively be curved. The ceramic component 310 may have overlapping complementary "L"-shaped edges or 45° bevelled edges or 90° parallel edges for abutting the ceramic components to form a ceramic component system to be described hereafter in FIG. 11. The size and shape of the ceramic component 310 may also be varied depending upon the size of the object to be protected.

In other embodiments (not shown), the shape, size, distribution pattern, and density of distribution of the nodes may be varied by those skilled in the art to achieve improved deflecting and defeating capabilities. The nodes may be spherical, conical, cylindrical, or a combination of thereof. The nodes may be small or large. If nodes of the same size are provided on the ceramic base, then the distribution is called "mono-size distribution." If nodes of different sizes are provided on the ceramic base, then the distribution is called "bi-modal distribution." The nodes may be distributed in a regular or random pattern. The nodes may be distributed in low or high density. Furthermore, half nodes are provided on the edges of each ceramic component base. The half nodes at the edges of two ceramic components, for example, become one when the ceramic bases are aligned and joined by an adhesive. Such arrangement of nodes at the edges protects an object from a threat at the joint points of ceramic components.

Figure 5:
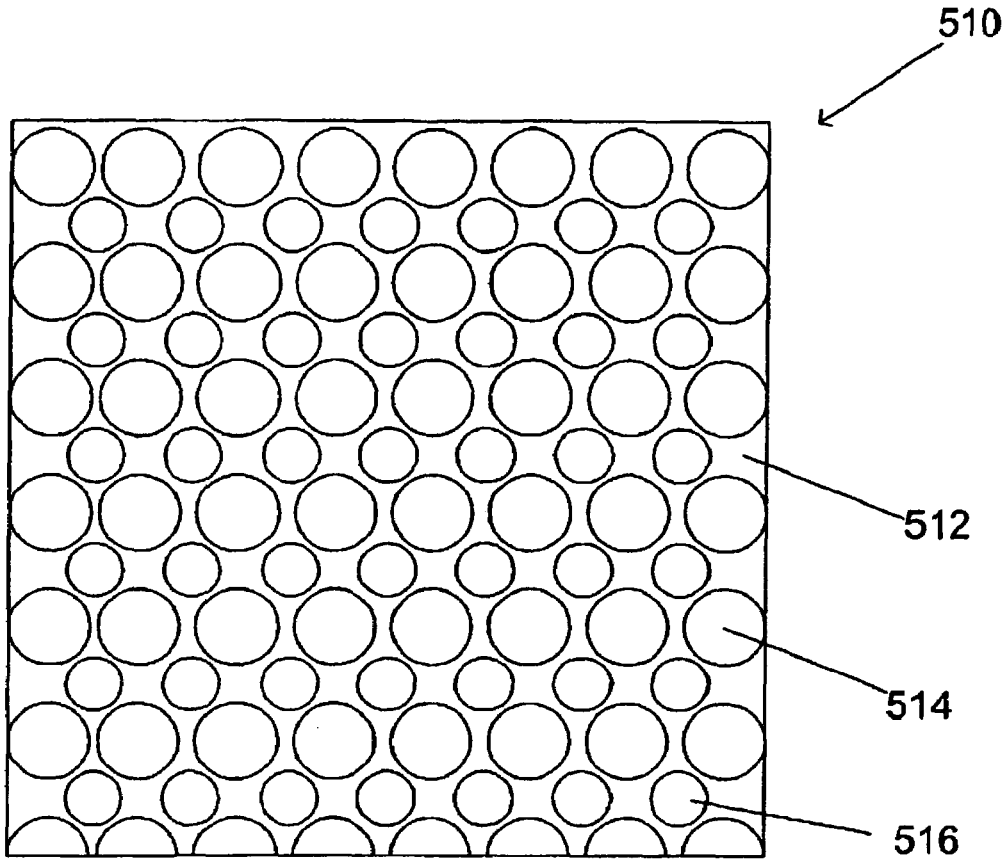
FIG. 5 is a top plan view of a square ceramic component comprising a ceramic base and spherical nodes of two different sizes.
Figure 6:
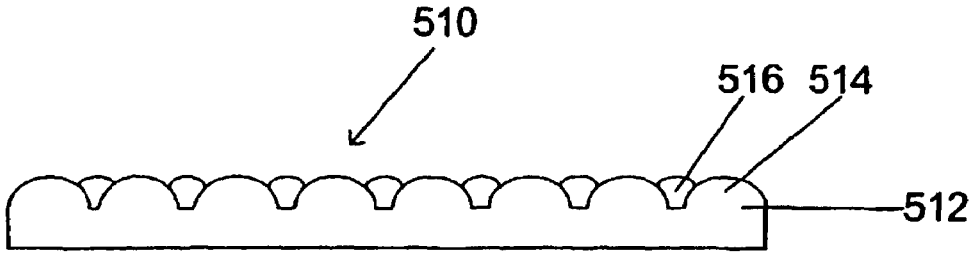
FIG. 6 is a side elevational view thereof.

Description of FIG. 5 and FIG. 6

FIG. 5 and FIG. 6 show a ceramic component 510 having a square ceramic base 512 with spherical nodes of two different sizes 514, 516 thereon which are distributed in a regular pattern of high density. While FIG. 5 shows the shape of the ceramic base 512 to be square, it can alternatively be rectangular, triangular, pentagonal, hexagonal, etc. The ceramic component 510 is shown to be planar, but it can alternatively be curved. The ceramic component 510 may have overlapping complementary "L"-shaped edges or 45° bevelled edges or 90° parallel edges for abutting the ceramic components to form a ceramic component system to be described hereafter in FIG. 11. The size and shape of the ceramic component 510 may also be varied depending upon the size of the object to be protected.

Figure 7:
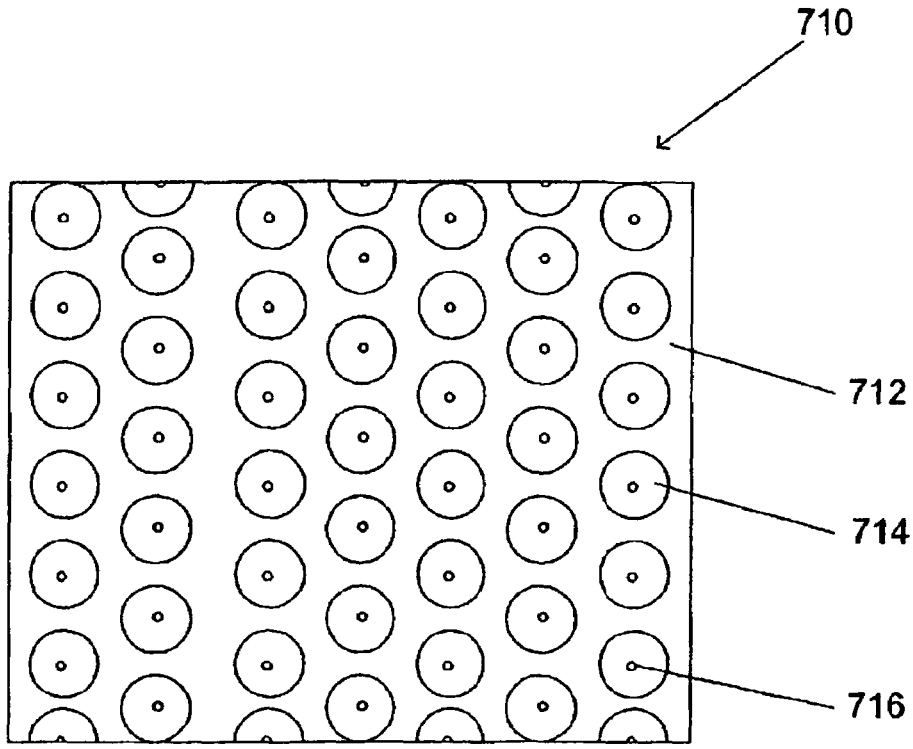
FIG. 7 is a top plan of a square ceramic component comprising a ceramic base and spherical nodes of one size that are provided with a longitudinal channel.
Figure 8:
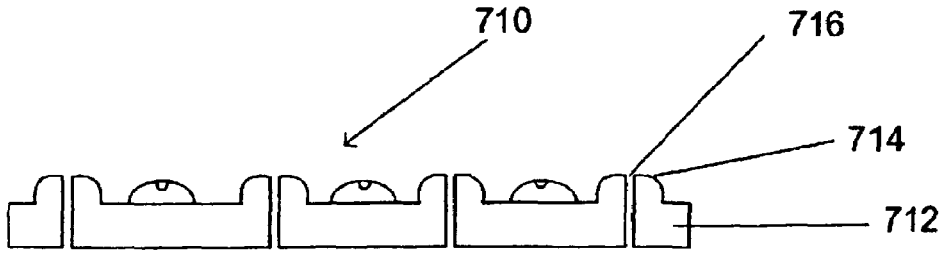
FIG. 8 is a side elevational view thereof.

Description of FIG. 7 and FIG. 8

In another embodiment, to reduce the weight of the ceramic component, a longitudinal channel is provided through each node and the ceramic base portion underneath each node. FIG. 7 and FIG. 8 show a ceramic component 710 having a square ceramic base 712 with spherical nodes 714 of one size thereon provided with longitudinal channels 716 therethrough. Not all nodes and the ceramic base underneath nodes may be provided with the channels. The provision of the longitudinal channels 716 reduces the weight of the ceramic component by up to 15% while maintaining the improved deflecting and defeating capabilities. While FIG. 7 shows the shape of the ceramic base 712 to be square, it can alternatively be rectangular, triangular, pentagonal, hexagonal, etc. The ceramic component 712 is shown to be planar, but it can alternatively be curved. The ceramic component 712 may have overlapping complementary "L"-shaped edges or 45° bevelled edges or 90° parallel edges for abutting the ceramic components to form a ceramic component system to be described hereafter in FIG. 11. The size and shape of the ceramic component 712 may also be varied depending upon the size of the object to be protected.

Figure 9:
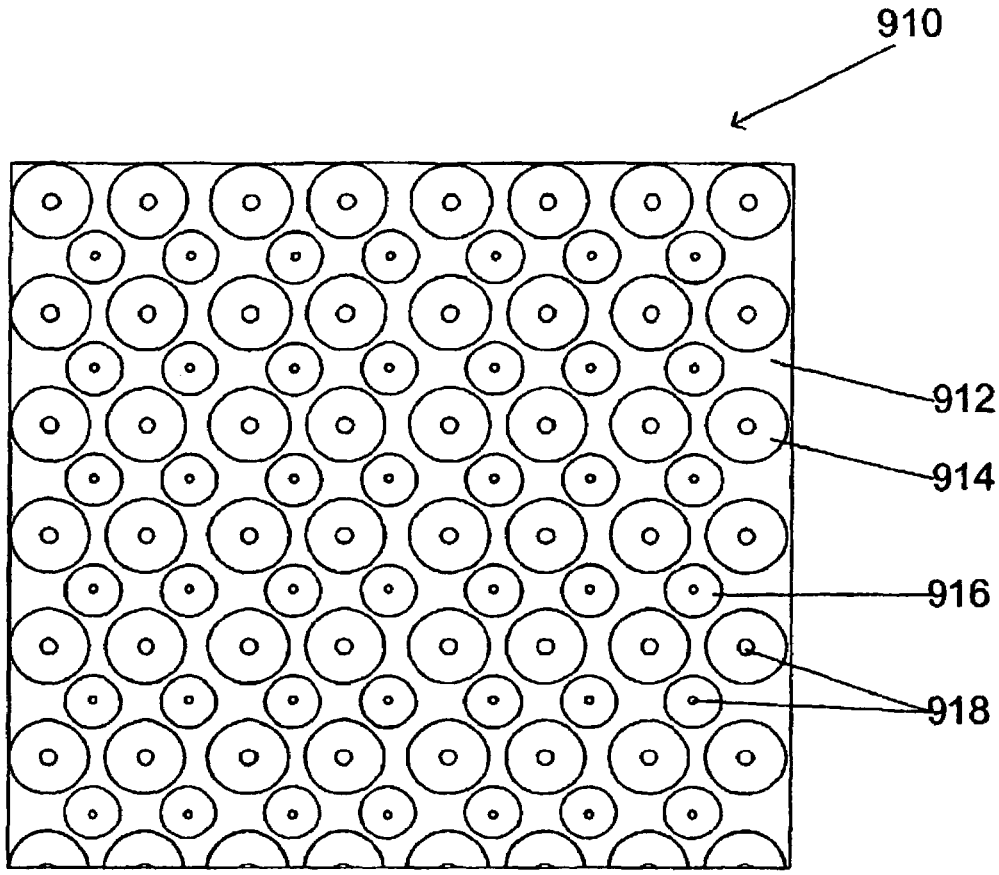
FIG. 9 is a top plan view of a square ceramic component comprising a ceramic base and spherical nodes of two different sizes that are provided with a longitudinal channel through each spherical node.
Figure 10:
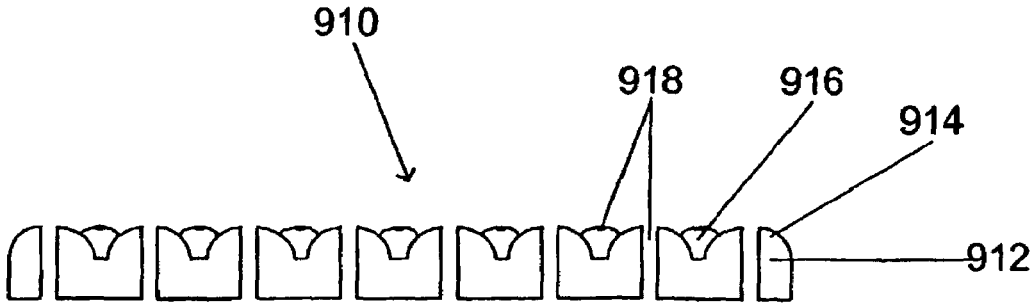
FIG. 10 is a side elevational view thereof.

Description of FIG. 9 and FIG. 10

FIG. 9 and FIG. 10 show a ceramic component 910 having a square ceramic base 912 with spherical nodes of two different sizes 914, 916 thereon which are each provided with a longitudinal channel 918 therethrough. Not all nodes and the ceramic base underneath the nodes may be provided with the channels. While FIG. 9 shows the shape of the ceramic base 710 to be square, it can alternatively be rectangular, triangular, pentagonal, hexagonal, etc. The ceramic component 910 is shown to be planar, but it can alternatively be curved. The ceramic component 910 may have overlapping complementary "L"-shaped edges or 45° bevelled edges or 90° parallel edges for abutting the ceramic components to form a ceramic component system to be described hereafter in FIG. 11. The size and shape of the ceramic component 910 may also be varied depending upon the size of the object to be protected.

Figure 11:
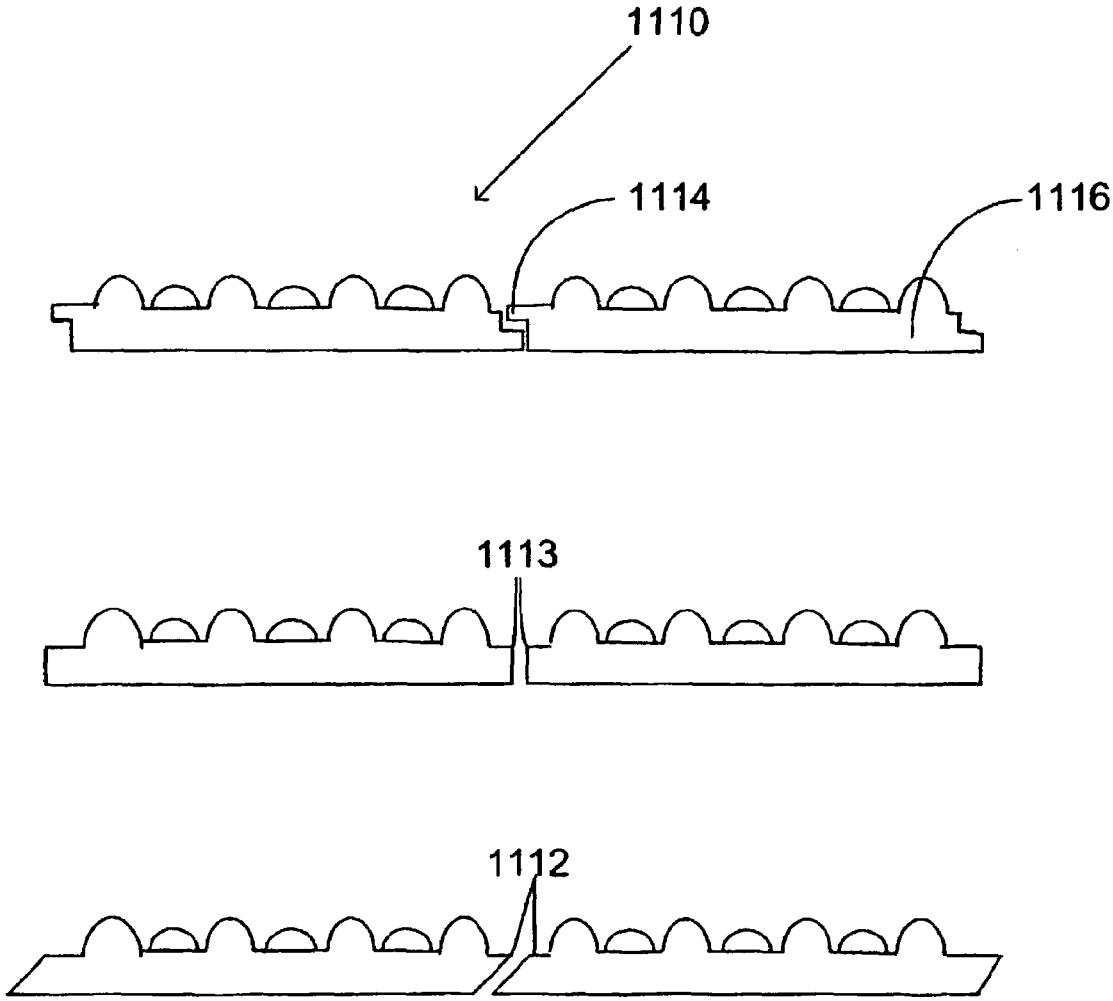
FIG. 11 is a cross-section of three embodiments of a ceramic component designated as Monolithic Advance Protection (MAP) formed by abutting a plurality of ceramic components.

Description of FIG. 11

In still another embodiment, the ceramic components described above may be joined to form a ceramic component system. FIG. 11 shows a cross section of three embodiments of a ceramic component system 110 formed by abutting a plurality of ceramic components which are described above in FIG. 3 to FIG. 10 and more especially the ceramic components shown in FIG. 9. Such a system is designated as Monolithic Advance Protection (MAP). The ceramic component is provided with, for example, "L"-shaped edges 1114, 1116 on each side of the component. Two adjacent ceramic components may be joined by aligning the "L"-shaped edges 114, 116 and by filling the gap with an adhesive, preferably polyurethane and/or polyurethane thermoplastic. The edges of the ceramic component may also be cut to provide 45° bevels 1112 to facilitate aligning. The bevelled edges of 45° provide flexibility to the ceramic component system or to the ceramic armour system where a plurality of components is used in assembling such systems. The edges of the ceramic component may be cut at 90° to provide edges 1113 to facilitate aligning.

Figure 12:
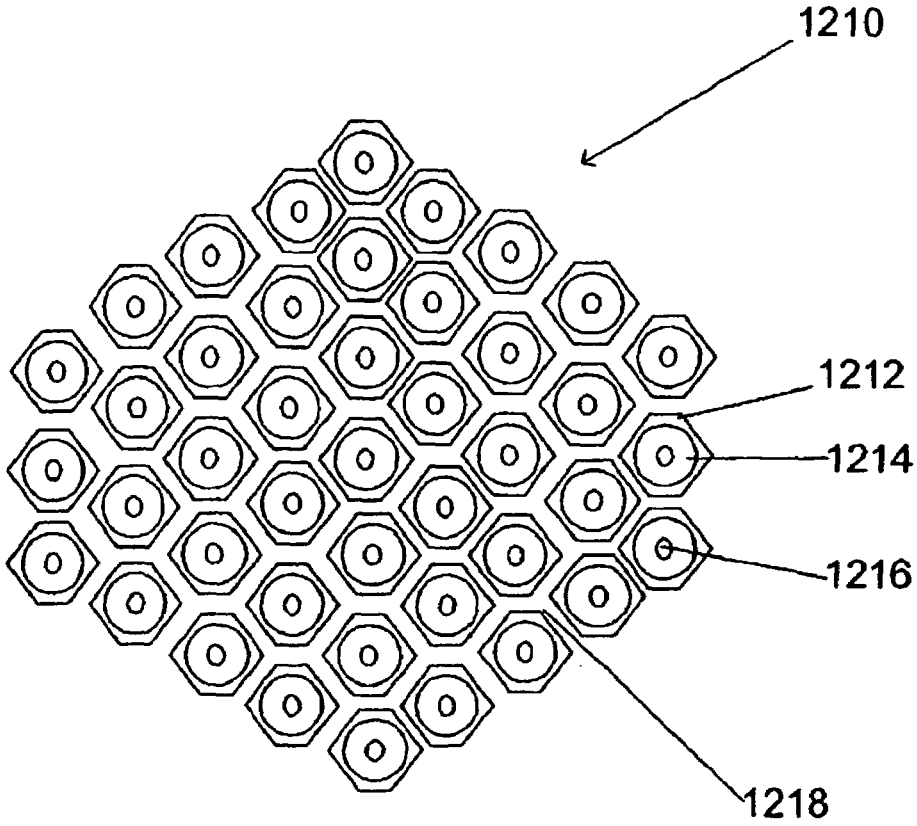
FIG. 12 is a top plan view of another ceramic component designated as Cellular Advance Protection (CAP) formed by embedding a plurality of ceramic components in a polymer adhesive matrix.

Description of FIG. 12

A still further embodiment is shown in FIG. 12 which shows a portion of the top plan view of another ceramic component systems that may be formed by embedding a plurality of ceramic components described above in FIG. 2 to FIG. 10 in a polymer adhesive matrix. Such a system is designated as CELLULAR ADVANCE PROTECTION (CAP). In the embodiment shown in FIG. 12, the CAP system 1210 comprises a plurality of ceramic components, each having a hexagonal ceramic base 1212 with one spherical node 1214 provided with a channel 1216 therethrough, that are joined together in a flat layer by an adhesive 1218, preferably polyurethane. In the case of CAP, smaller hexagonal ceramic components with one or few nodes are used. The layer of hexagonal ceramic components makes use of the space efficiently and creates a flexible ceramic system suitable for incorporation in armours for objects with contours, e.g., body parts.

Figure 13:
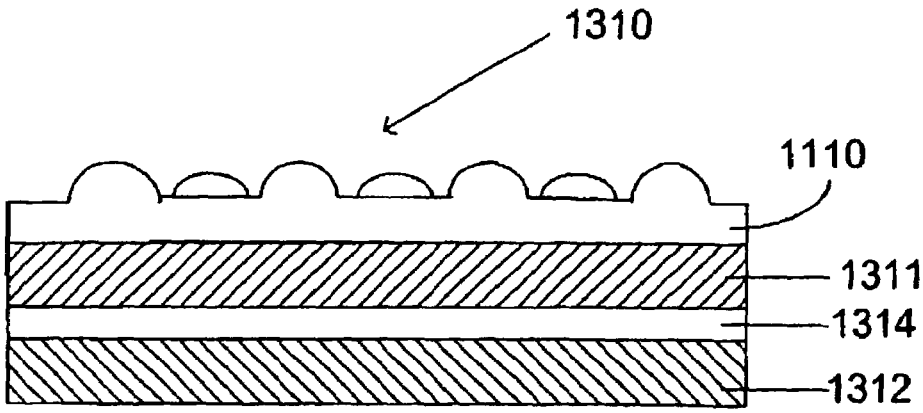
FIG. 13 is a cross-section of yet another ceramic component designated as Layered Advanced Protection (LAP) system.

Description of FIG. 13

An embodiment of a multi-layer ceramic component system is shown in FIG. 13 which shows a cross section of a LAYERED ADVANCE PROTECTION (AP) system 1310 for protecting an object from a high level of threat. The LAP system comprises at least one layer of the MONOLITHIC ADVANCE PROTECTION (MAP) system 1110 described above and at least two support layer 1311, 1312, which may be formed of ceramic components Which are devoid of nodes, or polymer-ceramic fibre composite components, or plastic components, or a combination thereof. The MAP system 1110 and the first support layer 1311 are bonded together by an adhesive. The adhesive may be polyurethane or ceramic cement. The second support layer 1312 is bonded to the first support layer 1311 and to the rear spall layer. In the embodiment shown in FIG. 13, the first and second support layers 1311, 1312 are formed of different ceramic components devoid of nodes which are prepared from the ceramic material CERAMOR™ or ALCERAM-T™. The CERAMOR™ is used for providing a mechanical function and ALCERAM-T™ is used for providing a thermo-mechanical function. The two support layers 1311, 1312 may be provided with an inter-layer 1314 of a polymer-ceramic fibre therebetween. The two layers 1311, 1312 and the inter-layer 1314 are bonded by an adhesive, preferably polyurethane. The two support layers 1311, 1312 may be duplicated as many times as desired depending upon the level of protection required.

Figure 14:
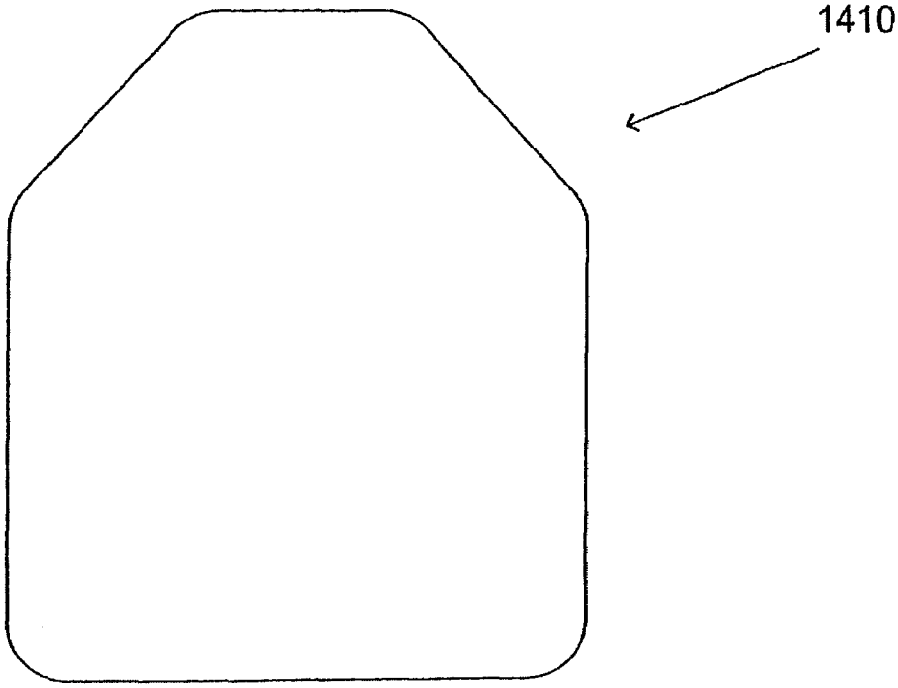
FIG. 14 is a top plan view of an improved personnel armour system.
Figure 15:
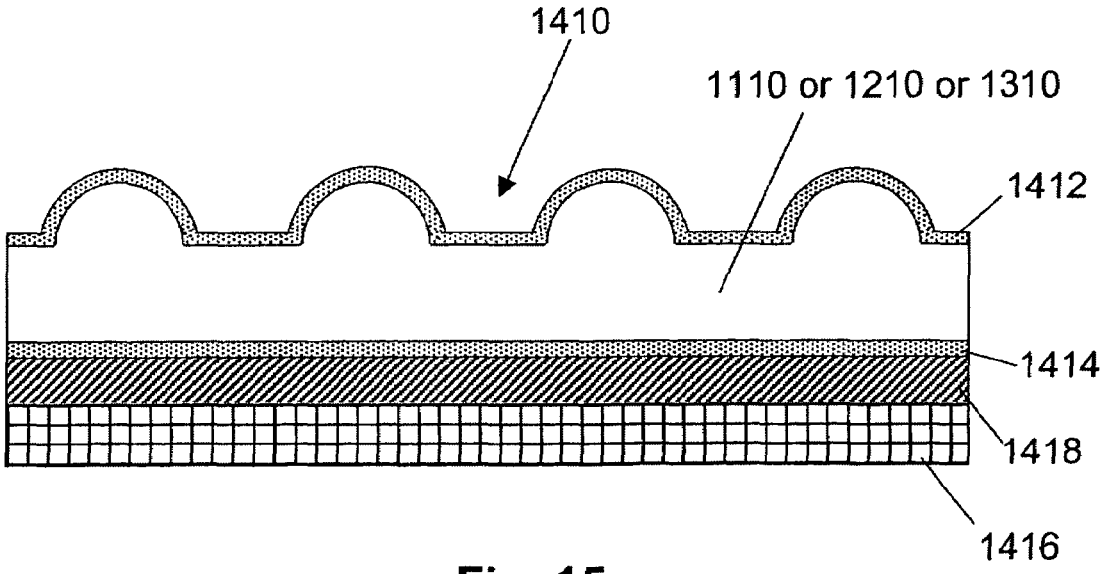
FIG. 15 is a cross-section view thereof.

Description of FIG. 14 and FIG. 15

The MAP, CAP, and LAP ceramic component systems described above may be used to make an improved personnel ceramic armour system. FIG. 14 and FIG. 15 show an embodiment of an improved personnel ceramic armour system 1410. This system comprises, in front to back order, at least one layer each of a front spall layer 1412, the ceramic component system, including MAP 1110, CAP 1210, or LAP 1310, a rear spall layer 1414, and a backing 1416. These layers are bonded together, preferably with an adhesive.

The front spall layer 1412 is a plastic sheath and is bonded to the front of the ceramic component system 1110, 1210, or 1310 by way of a polymer adhesive which is disposed between the nodes. The polymer adhesive is a thermoplastic, preferably a polyurethane adhesive and/or a polyurethane thermoplastic film.

The rear spall layer 1414 is also a plastic sheath and is bonded to the back of the ceramic component system 1110, 1210, or 1310 by a polymer adhesive, preferably polyurethane. The plastic sheath used in front spall layer 1412 and rear spall layer 1414 may be formed from a polycarbonate sheath. The polymer adhesive which is used to bond the rear spall layer 1414 to the ceramic component system 1110, 1210, or 1310 may be a polyurethane adhesive and/or a polyurethane thermoplastic. The spall layers i.e., the front spall layer 1412 and the rear spall layer 1414 are provided to improve multi-hit capability of the armour.

In a preferred embodiment, front spall layer 1412 and rear spall layer 1414 are comprised of a thin film, preferably polycarbonate but other plastic is also contemplated. An appropriate range for the polycarbonate is preferably between 0.007 inches and 0.030 inches. This thickness allows for the film to conform to the front surface of ceramic component system 1110, 1210, or 1310. Specifically, if ceramic component system 1110, 1210, or 1310 include nodes, the polymer film with a thickness between 0.007 inches and 0.030 inches is still able to conform to the shape of the nodes and follow the contours of the ceramic component system.

The use of front spall layer 1412 and rear spall layer 1414 is primarily to confine the ceramic and mitigate any spall. As would be appreciated by those skilled in the art, the thickness of the polycarbonate film is too thin to actually disturb the projectile and break any jacket of the projectile.

The front spall layer 1412 and rear spall layer 1414 are preferably bonded to the ceramic component system 1110, 1210 or 1310 by a polyurethane film adhesive with a thickness of between 0.015 inches to 0.025 inches.

The combination of polycarbonate and polyurethane film therefore allows the front and rear spall layers 1412 and 1414 respectively to conform to the front and rear surfaces of the ceramic component system and provide confinement of the ceramic.

The backing 1416 is at least one layer of poly-paraphenylene terephthalamide fibres, polyethylene, glass fibres, or a metal, wherein the metal may be steel, aluminum, or any other suitable metal. The poly-paraphenylene terephthalamide fibres, polyethylene, glass fibres are known by trade names of KEVLAR™, SPECTRA™, and DAYNEEMA™, respectively.

Alternatively, the backing 1416 could be made from a combination of fibres of KEVLAR™, SPECTRA™, and DAYNEEMA™, ZYALON™, TITAN ZYALON™, TITAN KEVLAR™, TITAN SPECTRA™, TWARON™, and SPECTRA-SHIELD™ to reduce cost and to obtain the same performance. Such backing is designated herein as "degraded backing." With the ceramic armour system of the present invention, the backing is required to capture fragments of the projectile only since the ceramic component system and shock-absorbing layer (described hereabove) stops the projectile before the projectile reaches the backing.

An interlayer 1418 may be disposed in-between the rear spall layer 1414 and the backing 1416 in order to reduce back face deformation. The inter-layer 1418 may be formed of a polymer-ceramic fibre composite.

Figure 16:
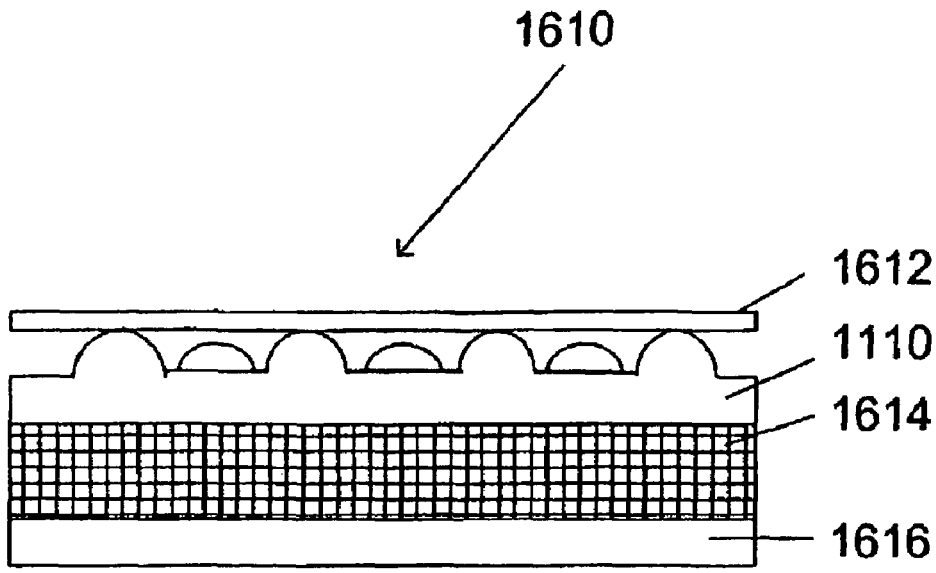
FIG. 16 is a cross section of another embodiment of an improved personnel ceramic armour system.

Description of FIG. 16

FIG. 16 shows one embodiment of an improved personnel ceramic armour system 1610 which includes, in front to back order, one layer of a polycarbonate front spall layer 1612, one layer of the ceramic component system MAP 1110 (as described hereabove), a shock-absorbing composite layer 1614 made of 2 to 8 layers of glass fibres or aramid fibres, carbon fibres, and polycarbonate, glass fibres, or carbon fibres, wherein each layer is disposed at a suitable angle e.g, 90° to the previous layer, and a degraded backing 1616. These layers are bonded together, preferably, with a polymer adhesive. The polymer adhesive is a thermoplastic, preferably a polyurethane adhesive and/or a polyurethane thermoplastic film. Instead of using an adhesive, the front spall, the shock-absorbing composite layer, and the degraded backing may be adhesive-impregnated, and thus may be used to manufacture the armour system.

In manufacturing, the personnel armour system is assembled as a sandwich by coating the adhesive on the rear side of the ceramic plate, then over laying the shock-absorbing layer or layers thereon, coating the rear side of the shock-absorbing layer or layers with an adhesive, over layering the backing over the adhesive, coating the front of the ceramic plate with the adhesive and over laying the front spall layer. All of the assembled layers are then held together with a plurality of clamps and placed in an autoclave under controlled temperature and pressure for integration.

Figure 17:
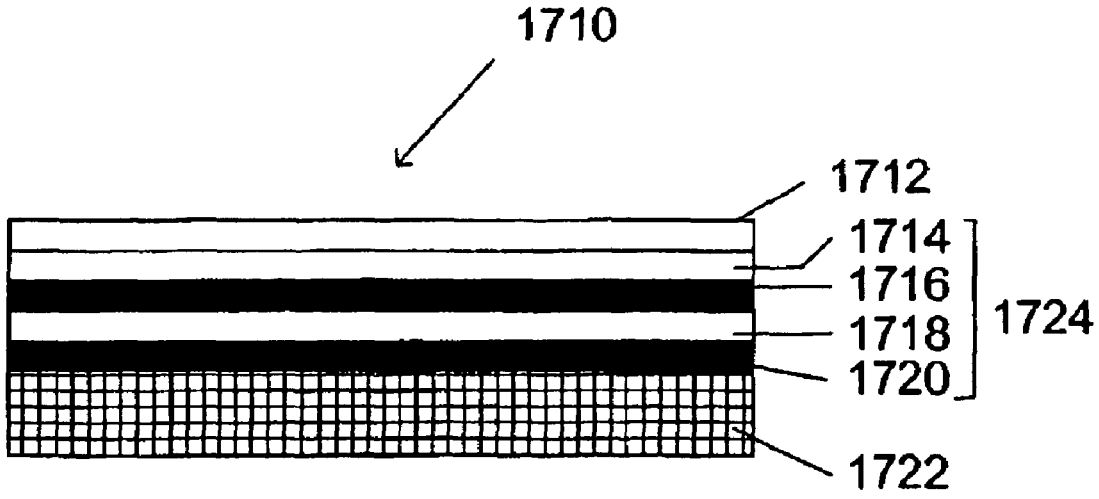
FIG. 17 is a cross section of yet another improved vehicle ceramic armour system utilizing LAP system.

Description of FIG. 17

FIG. 17 shown an embodiment of a LAP system for protection of vehicles from a high level threat posed by, for example, an RPG or shape charge. The ceramic component system is prepared by alternating layers of two different types of ceramics having different properties. For example, a layer of CERAMOR™ V which has high thermal property is alternated with a layer of CERAMOR™ L having a high ballistic property.

FIG. 17 shows a side view of an embodiment of an armour system 1710 utilizing a LAP system 1724 comprising in front to back order, a front spall layer 1712, a first layer of CERAMOR™ V 1714, a first layer of CERAMOR™ L 1716, a second layer of CERAMOR™ V 1718, a second layer of CERAMOR™ L 1720, and a shock-absorbing layer 1722. The complete assembly can then be bolted onto a vehicle for protection, preferably with an air gap or alternatively without an air gap. Such armour systems showed improved ballistic performance in tests done by Department of National Defence in Canada.

CERAMOR™ ceramic composite used in the present invention is a tough ceramic composite material that provides close multi-hit capability.

The personnel donning the armour are often subjected to multiple hits over time. Thus, from time to time it is essential to determine if the future protective capabilities of an armour have been compromised by past attacks. That is, it would be essential to determine stress level of a personnel armour system. The "stress level" herein means cracks appearing in the ceramic plate due to the number of hits taken by the armour. Normally, stress level of an armour system is determined by X-ray technique, which method is quite expensive.

In an embodiment, a cover of a pressure sensitive film (e.g., FUJI Film™) is provided over the front spall layer for determining stress level of a personnel armour system. Initially the film is transparent but depending upon the number of hits the armour takes, the film develops color spots corresponding to pressure points generated by hits. These color spots can then be used to determine the life of the armour and if the armour is still suitable to wear.

TESTS

When a plurality of individual ceramic components are used in making a ceramic armour system, individual ceramic components are aligned sideways by abutting "L"-shaped, 45° bevelled, or 90° parallel edges. The layer of ceramic components thus formed is overlaid with an adhesive, preferably polyurethane, between nodes to prepare a flat surface, followed by a layer of 1/16 or 1/32 inches of polyurethane thermoplastic sheet. The front spall layer made of polycarbonate or laminated plastic is then laid over the ceramic components and adhesives. The entire assembly of various layers is then subjected to a high pressure and temperature regime to bond ceramic components and various layers in the assembly. The rear spall layer and the backing may be bonded to assembled layers at the same time or they may be assembled in a group first and then the group is bonded to the assembled layers. Different layers may be bonded together in one group or in different groups. The different groups may then be bonded together to form one group. Epoxy resins may be used as an adhesive.

The improved deflecting and defeating capability of the ceramic components, ceramic component systems, and ceramic armour systems described herein was confirmed by conducting depth penetration tests. An armour is considered improved if it showed reduced depth of penetration or no penetration in comparison with penetration which was allowed by the prior art. As an example, the personnel ceramic armour system was subjected to depth penetration tests. In comparison to the prior art, ceramic components devoid of nodes, the personnel ceramic armour system shows reduced depth of penetration or no penetration.

A ceramic component devoid of nodes can only protect an object from the threat of a level IV armour-piercing projectile having a diameter of 7.62 mm. In comparison, the use of a single layer of a MAP ceramic component system can deflect and defeat a threat posed by a level V armour-piercing projectile having a diameter of 12.5 mm.

Often objects are subjected to higher levels of threats. Presently, only active armours are employed to protect objects, for example, tanks from high level threats. A Rocket Propelled Grenade (RPG) usually poses such a threat. The active armours generally include explosives that are provided on vulnerable areas of the object to be protected to counter-attack the approaching RPG. The active armours, though effective, can accidentally explode onto the surface of the object to be protected, thereby endangering the object and/or the life of the personnel inside the object. Generally, the RPG ejects molten Cu (Cu plasma jet) at a very high temperature and pressure onto the surface of the object after the impact. The Cu plasma jet pierces through the walls of the object and provides an avenue for the entry of bomblets into the object. Once inside the object, the bomblets explode, destroying the object and the personnel inside the object. The Cu plasma jet can pierce through 0.8 to 1.0 m of steel or 5 feet of concrete.

A multi-layer ceramic component system disclosed herein has been shown to deflect and defeat the high level of threat posed by the Cu plasma jet of the RPG. In addition to MAP on the top, one such system provides two supporting layers underneath the MAP. The two supporting layers made from two types of ceramic material, each having different high melting temperature resisting-properties and pressure-resisting properties. These support layers protect the object from the Cu plasma jet of the RPG in a stepwise manner. For example, first support layer which is made of CERAMOR™ which has a melting temperature of 2500° C. provides the first level of resistance to the high temperature and pressure of the Cu plasma jet of the RPG. The first layer absorbs most of the temperature and a part of the pressure from the Cu plasma jet of the RPG, but the first support layer eventually cracks. The second support layer which is made of ALCERAM-T™ which has a melting temperature of 3000° C. provides the second level of resistance to the high temperature and pressure of the Cu plasma jet of the RPG. The second layer absorbs the remaining temperature and pressure of the Cu plasma jet of the RPG, and does not melt or crack. Even if the second layer melts or crack, when the heat will have dissipated, the second support layer will solidify again to provide protection. Thus, by providing two support layers of different ceramic materials, the present invention protects against the high temperature and pressure generated by the Cu plasma jet of the RPG. The two support layers may also dissipate the temperature radially. The two support layers may be provided with an interlayer of polymer-ceramic fibres therebetween to provide more resistance to the temperature effect of the Cu plasma jet of the RPG.

The ceramic armour systems of the present invention passed the most stringent international testing. All CERAMOR™ systems were extensively tested for National Institute of Justice level III and IV threats. The testing of armour samples was conducted by HP White Laboratory (3114, Scarboro Road Street, Md. 21154-1822, USA). A variety of ammunition was used during testing.

Test 1

The test samples for the personnel protection armour system were mounted on an indoor range 50 feet from the muzzle of a test barrel to produce zero degree obliquity impacts. Photoelectric lumiline screens were positioned at 6.5 and 9.5 feet which, in conjunction with elapsed time counter (chronographs), were used to compute projectile velocities 8.0 feet forward of the muzzle. Penetrations were determined by visual examination of a witness panel of 0.020 inch thickness of 2024T3 aluminum positioned 6.0 inches behind and parallel to the test samples.

It was found that a CERAMOR™ MAP strike plate of 2.6 kg could stop two 7.62 mm AP M2 projectiles at a velocity of 875 m/s or two 7.62. AP Swiss projectiles with tungsten carbide core at 825 m/s.

A CERAMOR™ MAP strike plate armour system having 3.5 lbs/sq.ft. of ceramic weight and total weight of 5.65 lbs/sq.ft. with SPECTRA™ backing was tested for level III+ test which has a requirement of stopping two bullets out of four bullets. The CERAMOR™ MAP strike plate test armour stopped the all four bullets.

A CERAMOR™ MAP strike plate armour system having 4.5 lbs/sq.ft. of ceramic and total weight of 6.5 lbs/sq.ft. was tested for level IV+ test which has a requirement of stopping one 7.62 mm AP M1 bullet. This CERAMOR™ MAP strike plate armour system stopped two 7.62 mm AP M1 bullets.

Test 2

The test samples for the vehicle protection armour system were mounted on an indoor range of 45 feet from the muzzle of a test barrel to produce zero degree obliquity impacts. Photoelectric lumiline screens were positioned at 15.0 and 35.0 feet which, in conjunction with elapsed time counter (chronographs), were used to compute projectile velocities 25 feet forward of the muzzle. Penetrations were determined by visual examination of a witness panel of 0.020 inch thickness of 2024T3 aluminum positioned 6.0 inches behind and parallel to the test samples.

The test armour plate of the present invention having a size of 12"×12" was hit by 5 projectiles (14.5 mm AP B32) at 900 m/s at less than 2" apart. No penetration was observed.

CONCLUSION

The effectiveness of a ceramic component, and of an armour using such ceramic components, in protecting an object from the impact of projectile is improved by providing nodes on the front surface of the ceramic base. The provision of nodes adds the deflecting capability to the ceramic component and to the armour using ceramic components. The nodes change the angle of the impacted projectile and retard the passage of the projectile through the ceramic component. The projectile is then easily defeated. The presence of nodes on the ceramic component disclosed in the present invention is more effective in protecting an object than a ceramic component devoid of nodes, thereby eliminating the need for using thicker ceramic components for protecting an object from the same level of threat. The reduced thickness leads to a lighter ceramic component, ceramic component system, and ceramic armour system. The provision of channels also adds to the lightness of ceramic components and ceramic armour systems. The stealth features, e.g., air gap, foam layer, and camouflage surface minimizes the attack.

Thus, the ceramic armour systems of the present invention provide improved ballistic performance and survivability, multi-hit capability, reduced damaged area, low areal density, flexible design, reduced back face deformation, shock, and trauma, and many stealth features over prior art systems. The ceramic armour system for vehicles, crafts, and buildings in addition also protects the surfaces of these structures from damage by fragments. For example, in the case of a vehicle, it protects the hull. The ceramic armour systems for vehicles, for example, tanks, can also be used as an add-on armour without the requirement of an internal liner.

The armour system described herein functions to protect an object by deflecting and defeating a projectile. The ceramic armour system provides better protection from projectile threats to ground vehicles, aircrafts, watercrafts, spacecrafts, buildings, shelters, and personnel, including body, helmet and shields.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

The invention claimed is:

1. An armour plate for use in personal vehicular and structural armour systems comprising:

i) a central layer formed of an integral ceramic plate having a thickness selected to impart a high impact strength thereto, said central layer having an inner surface and an outer surface;

ii) a first thin layer of high shear strength polymer film adhesively affixed to the inner surface of said central layer;

iii) a second thin layer of high shear strength polymer film adhesively affixed to the outer surface of said central layer;

wherein said first and second layers of polymer film are thick enough to increase the flexural strength of said central layer, and localize shattering of said central layer after the impact of high speed projectiles on said plate and having a thickness in the range of 0.007 to 0.030 inches.

2. The armour plate of claim 1 wherein the polymer film is adhesively fixed through a polyurethane film adhesive.

3. The armour plate of claim 2 wherein the polyurethane film adhesive has a thickness of between 0.015 inches and 0.025 inches.

4. The armour plate of claim 1 wherein the first and second thin layer of high shear strength polymer film are comprised of polycarbonate.

5. The armour plate of claim 1 wherein the second thin layer is adapted to follow a contour of said outer surface of said central layer.

6. The armour system of claim 1 wherein said central layer includes nodes extending outwardly from the outer surface of said central layer.

7. The armour plate of claim 6 wherein the second thin layer is adapted to follow contours of the nodes and to fit between the nodes of said central layer.

8. The armour plate of claim 1, further comprising an adhesive layer affixing the first thin layer of high shear strength polymer film to the inner surface of said central layer.

9. The armour plate of claim 1, further comprising an adhesive layer affixing the second thin layer of high shear strength polymer film to the outer layer of said central layer.

* * * * *